United States Patent [19]

Forester

[11] Patent Number: 5,019,241

[45] Date of Patent: May 28, 1991

[54] METHOD OF PASSIVATING ALKALI METALS ON FLUID CATALYTIC CRACKING CATALYSTS USING ALUMINUM CONTAINING COMPOUNDS

[75] Inventor: David R. Forester, Conroe, Tex.

[73] Assignee: Betz Laboratories, Inc., Trevose, Pa.

[21] Appl. No.: 515,815

[22] Filed: Apr. 27, 1990

[51] Int. Cl.[5] ..... C10G 11/18

[52] U.S. Cl. ..... 208/120; 208/52 CT; 208/121; 208/122; 208/153; 502/521; 502/516

[58] Field of Search ..... 208/120, 122, 121, 52 CT; 502/521

[56] References Cited

U.S. PATENT DOCUMENTS

| | | | |
|---|---|---|---|
| 2,480,627 | 8/1949 | Bodkin et al. | 252/412 |
| 2,901,419 | 8/1959 | Brill | 208/119 |
| 4,198,320 | 4/1980 | Chester et al. | 252/455 Z |
| 4,289,608 | 9/1981 | McArthur | 208/121 |
| 4,317,713 | 3/1982 | Burk, Jr. et al. | 208/113 |
| 4,318,799 | 3/1982 | Yoo | 208/114 |
| 4,319,983 | 3/1982 | Yoo | 208/114 |
| 4,337,144 | 6/1982 | Yoo | 208/120 |
| 4,437,981 | 3/1984 | Kovach | 208/253 |
| 4,454,025 | 6/1984 | Hettinger, Jr. | 208/120 |
| 4,496,665 | 1/1985 | Hettinger Jr. et al. | 502/521 |
| 4,584,283 | 4/1986 | Bertus et al. | 502/31 |
| 4,664,779 | 3/1987 | Bertus et al. | 208/114 |
| 4,728,629 | 3/1988 | Bertus et al. | 502/62 |
| 4,889,617 | 12/1989 | English | 208/121 |

*Primary Examiner*—Helane E. Myers

*Attorney, Agent, or Firm*—Alexander D. Ricci; Gregory M. Hill

[57] ABSTRACT

In a hydrocarbon fluid catalytic cracking process, high concentrations of sodium in the hydrocarbon entering the reactor will poison the reaction sites on the FCC catalysts, thereby reducing the efficiency of the cracking process. The addition of an aluminum compound to the hydrocarbon significantly reduces the poisoning effect of the sodium on the catalyst. The aluminum compound may be selected from the group consisting of aluminum nitrate, aluminum isopropoxide, aluminum oxide and sulfate salts of aluminum.

13 Claims, No Drawings

METHOD OF PASSIVATING ALKALI METALS ON FLUID CATALYTIC CRACKING CATALYSTS USING ALUMINUM CONTAINING COMPOUNDS

FIELD OF THE INVENTION

The present invention relates to the petroleum refining industry and is specifically directed toward the problems caused by the poisoning of the cracking catalysts by alkali metals, such as sodium. Excessive concentrations of alkali metals in the hydrocarbon medium will contaminate the catalysts resulting in a reduction in the rate of conversion. This invention passivates the alkali metals thereby improving the conversion rate and/or improving the efficiencies of the cracking process.

BACKGROUND OF THE INVENTION

Catalytic cracking processes utilize zeolite-containing catalysts to produce light distillate fractions, such as gasoline, from heavier hydrocarbon feedstocks. Deterioration of the cracking catalyst occurs when metal contaminants introduced into the fluid catalytic cracking (FCC) zone with the feedstock deposit on the catalyst. These metal contaminants result in zeolite destruction and catalyst deactivation, particularly under the oxidizing, high temperature (>1300° F.) conditions used to regenerate the catalyst after the cracking zone. Contaminants in FCC hydrocarbon feedstocks are both naturally occurring in the crude oil and picked up during processing. Heavy metals, such as nickel, vanadium, iron and copper, usually occur naturally in the crude oil and are concentrated in the residual bottom streams from atmospheric and vacuum distillation processes. Iron and copper contaminants are also picked up in the residual oils during processing due to corrosion and erosion of vessels and transfer lines. Alkali metals (i.e., lithium, sodium, potassium, rubidium or cesium) are naturally occurring in crude oil and their concentration is usually reduced significantly by desalting processes. However, rapid fluctuations in feed quality can lead to desalter upsets with significant amounts of alkali metals carrying into down stream processing. Also, off specification streams or residual oils are frequently added to FCC feedstocks to reduce waste resulting in increased levels of alkali metals. Caustics, such as sodium hydroxide, are frequently used at several points in the refinery for chloride neutralization. The NaCl crystals thus formed concentrate in the bottoms which are frequently added to FCC feedstocks. Additional use of alkali metal contaminated water or steam around an FCC unit can contribute added contaminants to the catalyst.

Alkali metals deactivate FCC catalysts by two known mechanisms. The first results in the loss of cracking activity due to neutralization or poisoning of the acid sites. The alkali metal oxides can also combine with silica and/or alumina present as part of the catalyst matrix to form salts. Usually enhanced by the presence of steam, these high temperature fluxing reactions result in zeolite destruction and reduced catalytic activity causing a decrease in the relative amount of feedstock that is converted to lighter distillate fractions, such as gasoline.

PRIOR ART

Several U.S. patents have been found which teach and claim the use of aluminum and aluminum containing compounds as metal passivators in FCC catalysts. In all of these patents, the metal contaminants being passivated are iron, nickel, vanadium and copper. Two patents distinquish between alkali metal and heavy metal contamination (Yoo, U.S. Pat. Nos. 4,337,144 and 4,318,799). Alkali metals deactivate the catalyst without changing the product distribution in contrast to heavy metals, such as iron, nickel, vanadium and copper, which alter the selectivity and activity of the cracking reactions as they accumulate on the catalyst. In U.S. Pat. No. 4,337,144 alkali metals are acknowledged to be a potential poison to the catalyst. This patent provides no teaching as to the potential of aluminum containing compounds to passivate alkali contaminants on FCC catalysts. Additionally, its examples and claims are for catalysts contaminated with nickel, vanadium, copper and/or iron only. Also the aqueous aluminum containing solutions used to passivate the metal contaminated catalysts must be pH adjusted to precipitate the aluminum onto the catalyst. Further, the aluminum passivated catalysts require treatment with hydrogen peroxide in order to improve catalyst activity and reduce coke and hydrogen make.

Similar to the '144 and '799 patents is another patent to Yoo, U.S. Pat. No. 4,319,983. The '983 patent relates to a process of contacting a regenerated catalyst with one or more silicon containing materials alone or in combination with aluminum and/or phosphorus containing materials. The process is directed at passivating heavy metals such as nickel, vanadium, iron and copper.

U.S. Pat. No. 4,317,713, Burk, Jr., et al, uses an in situ aluminum compound to passivate contaminant metals that are deposited on the catalyst during cracking reactions. The alumina already present in the catalyst is "dissolved" using an aqueous $SO_2$ solution, then reprecipitated onto the catalyst. The contaminant metals present on the catalyst are said to be iron, nickel, vanadium and/or copper.

U.S. Pat. No. 2,901,419, Brill, mentions the possible use of Group III metals and compounds (among many others) as metal contaminant passivators for use in activated clay catalysts. Contaminants taught are iron, nickel and vanadium only and no data is given to support any compounds except zinc or zinc fluoride. Also, zeolite containing FCC catalysts are quite different than activated clay catalysts.

U.S. Pat. Nos. 4,584,283, 4,664,779 and 4,728,629, all to Bertus, et al., are related and teach the use of aluminum containing compounds to passivate iron, nickel and/or vanadium contaminants on FCC catalysts. The most preferred method or composition uses the sulfur or phosphorus containing aluminum compounds. While sodium is shown to be present in the catalysts (as virtually all catalysts contain sodium from the manufacturing process), no teaching or data are shown to indicate aluminum compounds passivate sodium contaminants.

U.S. Pat. Nos. 4,289,608, McArthur, discloses a process for catalytically cracking hydrocarbon feedstocks in which aluminum compounds are deposited on the catalysts as passivating agents for metal contaminants such as nickel, iron, vanadium and copper. Alkali metal contaminants are not discussed.

U.S. Pat. No. 4,198,320, Chester et al., claims that the incorporation of colloidal dispersions of silica, alumina, or silica/alumina into the catalyst subsequent to gel formation results in resistance to metal poisoning and reduction in hydrogen and coke yields due to contaminants. The primary metal contaminants listed are nickel and vanadium with iron, copper or molybdenum also mentioned. No teaching concerning alkali metal contaminants is indicated. The only example given of alumina treatment (Catalyst 6C of Col 6), showed conversion and coke/hydrogen yields very similar to the nickel/vanadium contaminated catalyst without added colloidal alumina.

U.S. Pat. No. 4,454,025, Hettinger, Jr., teaches the passivation of heavy metal contaminants by adding aluminum, zirconium, silicon or titanium compounds to the catalyst or feedstock to reduce the amount of gas formation caused by heavy metals. Alkali metal contamination is discussed but potential solutions only include selecting feedstocks with specific levels of sodium and "careful desalting".

U.S. Pat. No. 4,496,665, Hettinger Jr., et al., teaches processes where titanium, zirconium or aluminum compounds are added to hydrocarbon feedstock to restore cracking activity of metal contaminated catalysts. The standard nickel, vanadium, iron, and copper metal contaminants are mentioned. The purposes of the additives are to regenerate new acid sites in the matrix in order to promote cracking of large molecules. The only example was treated with titanium and only titanium or zirconium are claimed, not aluminum. Alkali metals (such as sodium) are mentioned as troublesome materials, but are distinguished from heavy metals (Ni, V, Fe, or Cu) and are clearly thought to present minimal problems on FCC catalysts, especially compared to heavy metals. The alkali metals "can be economically removed by desalting operations, which are part of the normal procedure for pretreating crude oil for fluid catalytic cracking."

U.S. Pat. No. 4,437,981, Kovach, claims to immobilize contaminant metals (Na, Mg, Ca, K, V, Ni, Cu and Fe) in crude oil by adding compounds containing titanium, zirconium, manganese, lanthanum, or indium. No mention of aluminum compounds is made and it is not known if they would immobilize these metals in crude oil. The specific examples show titanium to react with sodium hydroxide or vanadium naphthenate. Additions of sodium or vanadium titanates to catalysts did not reduce catalyst activity as sodium or vanadium would normally. Only titanium, zirconium or indium are claimed to immobilize alkaline and metal contaminants in crude oils.

U.S. Pat. No. 4,889,617, English, teaches the use of tin, preferably an organic compound thereof, to passivate sodium in FCC units. No reference is made to the use of aluminum for this purpose. Also, '617 claims that tin is effective when incorporated into the catalyst.

SUMMARY OF THE INVENTION

It is an object of the present invention to minimize the deleterious effect of the poisoning of fluid catalytic cracking catalysts by alkali metals during the refining of hydrocarbon feedstocks. These alkali metals are present in all feedstocks in varying concentrations. However, when large excesses of alkali metals are present in the feedstock, either naturally occurring or due to processing problems such as from an upset in the desalter, the alkali metal concentration in the feedstock as it enters the reactor will be in the range of from 0.1 ppm to 10 ppm, generally from 0.5 ppm to 10 ppm. These alkali metals, specifically sodium, will bond to the reaction sites on the FCC catalysts thereby contaminating these catalysts and rendering them less effective in performing their intended hydrocarbon cracking function. The deactivation of the catalyst by sodium is enhanced by the hydrothermal and oxidizing environment used to regenerate the catalyst.

It has been discovered that an aluminum containing compound added to the catalyst containing the sodium contaminant prior to steam deactivation partially passivates the sodium. These passivated metals are then not available to poison or deactivate the reaction sites on the FCC catalysts during steam deactivation or the cracking reaction.

DETAILED DESCRIPTION OF THE INVENTION

Conventional FCC catalysts, such as silica-alumina zeolites, usually contain residual sodium, generally about 2000 ppm, remaining from the manufacturing process. With high sodium concentrations in the hydrocarbon feedstock, such as in excess of 0.5 ppm sodium with a probable range up to about 10 ppm, an additional 2000–5000 ppm sodium will deposit on the catalyst, "poisoning" reaction sites. This, of course, lowers the rate at which the catalyst converts, or cracks, the longer carbon chain molecules into smaller carbon chain molecules.

In accordance with the present invention, aluminum is added to the hydrocarbon feedstock in combination with a host of anions, excluding however, those containing halogen atoms. Specifically, aluminum isopropoxide, aluminum nitrate, aluminum oxide and sulfate salts of aluminum are especially useful. The aluminum compounds may be either shot fed or continuously fed into the feedstock. The compound may be fed to the feedstock prior to reaching the reactor or it may be fed into the reactor itself. Also, aluminum compounds may be added directly to the catalyst during processing.

Treatment levels will vary with the particular refinery conditions and feedstock makeup. The treatment dosage is most effectively based upon a molar ratio of sodium, either in the feedstock or as add-on (above the sodium level from the manufacturing process) to the catalyst, to aluminum having a range of 1:1 to 1:10 aluminum:sodium. Optimum results occur with a range of 1:1 to 1:4 aluminum:sodium.

To determine the effects of contaminant sodium on FCC catalyst activity, a commercial silica-alumina zeolite partially rare earth exchanged catalyst from Katalystics was used. Analysis of this catalyst showed it contained 0.26 weight % sodium and 23.0 weight % aluminum from the manufacturing process. Following impregnation with approximately 4000 ppm sodium and subsequent calcination and steam deactivation, it was analyzed and found to contain 0.71% sodium and 23.1% aluminum.

The fresh catalyst was calcined in air at 649° C. for 0.5 hour, then impregnated with 2000 to 15,000 ppm sodium from 2% sodium aqueous solutions of bicarbonate (BC), chloride (Cl) or hydroxide (OH) salts. These catalysts were oven dried to remove the water, then calcined in air at 649° C. for 1.0 hour. Subsequently, each catalyst was steam deactivated in a quartz reactor at 760° C. for 6.5 hours. The fresh calcined catalysts were also steam deactivated under identical conditions. These catalysts were evaluated for catalyst activity using a Microactivity Test (MAT) similar to that described in the ASTM D-3907 standard method.

The feedstock used for these evaluations was a mid-continent gas oil from a Pennsylvania refinery which exhibited an approximate boiling point range of 260° C.

to 540° C. In these MAT experiments, the catalyst to oil ratio was varied from 3.0 to 5.0 by increasing the catalyst weight and keeping the amount of feedstock constant. A quartz reactor was used at a reactor temperature of 482° C.

A total of 15 MAT experiments were conducted on three samples of steamed fresh calcined catalysts (A, B and C). The results from these tests are shown in Table 1. Using the data from these experiments, a linear least squares regression equation for predicted conversion was determined as follows:

Predicted conversion=2.52 * catalyst/oil ratio+39.7 * hydrogen +2.27 * coke+47.6.

Values for hydrogen and coke are expressed as weight percent of total fresh feed (FF).

This equation was found to exhibit a confidence level of 99.999+% and determined to fit 91% of the observed conversion data. Predicted conversions calculated using this equation are shown in Table 1.

A total of 35 MAT experiments were conducted on 15 samples of sodium impregnated catalysts that were calcined and steam deactivated as discussed above. The results from these experiments are shown in Table 2 as catalysts D through S. Using the equation determined from the non-sodium contaminated catalyst experiments, predicted conversions were calculated from the data on the sodium contaminated catalysts as shown in Table 2.

The added sodium contaminant, regardless of the salt used, was found to significantly decrease catalyst activity in approximately direct proportion to the level of sodium added as shown in Table 2. Although the Katalystics catalyst was analyzed to contain about 23.0% aluminum, presumably as alumina in the matrix and aluminum atoms in the zeolite framework, it appeared to show no effect in reducing the deleterious effects of the added sodium contaminant.

TABLE 1

MAT RESULTS ON FRESH STEAMED CATALYST

| Catalyst # | Cat/Oil Ratio | Conversion Wt % | Hydrogen Wt % FF | Coke Wt % FF | Predicted[1] Conversion | Conversion Difference |
|---|---|---|---|---|---|---|
| A | 3.01 | 61.8 | 0.050 | 2.02 | 61.8 | 0.0 |
| A | 3.09 | 62.2 | 0.073 | 3.06 | 65.2 | −3.0 |
| A | 4.02 | 67.6 | 0.087 | 3.00 | 68.0 | −0.4 |
| A | 4.10 | 69.4 | 0.077 | 4.08 | 70.2 | −0.8 |
| A | 5.08 | 73.8 | 0.105 | 4.04 | 73.7 | 0.1 |
| A | 5.03 | 77.3 | 0.179 | 4.00 | 76.5 | 0.8 |
| B | 2.83 | 65.7 | 0.114 | 2.16 | 64.2 | 1.5 |
| B | 3.02 | 68.9 | 0.110 | 2.99 | 66.4 | 2.5 |
| B | 3.03 | 67.2 | 0.095 | 2.96 | 65.7 | 1.5 |
| B | 4.57 | 74.6 | 0.144 | 4.51 | 75.1 | −0.5 |
| B | 4.45 | 74.3 | 0.141 | 3.70 | 72.8 | 1.5 |
| B | 4.27 | 74.5 | 0.260 | 3.60 | 76.9 | −2.4 |
| C | 3.07 | 58.4 | 0.048 | 1.07 | 59.7 | −1.3 |
| C | 4.01 | 63.0 | 0.073 | 1.48 | 64.0 | −1.0 |
| C | 4.98 | 69.2 | 0.093 | 1.84 | 68.0 | 1.2 |

[1]Predicted Conversion, Wt % = 2.52* cat/oil + 39.7* Hydrogen + 2.27* coke + 47.6

TABLE 2

MAT RESULTS ON SODIUM CONTAMINATED, STEAMED CATALYSTS

| CAT # | NA, PPM (SALT) | CAT/OIL RATIO | CONV. WT % | $H_2$ WT % | COKE WT % FF | PRED.[1] CONV. | CONV. DIFF. |
|---|---|---|---|---|---|---|---|
| D | 2000 (BC) | 3.05 | 59.4 | 0.111 | 3.01 | 66.5 | −7.1 |
| D | 2000 (BC) | 4.43 | 69.4 | 0.133 | 3.70 | 72.4 | −3.0 |
| E | 2000 (Cl) | 3.05 | 60.2 | 0.158 | 2.26 | 66.7 | −6.5 |
| E | 2000 (Cl) | 4.58 | 73.2 | 0.294 | 3.79 | 79.4 | −6.2 |
| F | 2000 (OH) | 3.20 | 64.8 | 0.150 | 2.33 | 66.9 | −2.1 |
| F | 2000 (OH) | 4.59 | 76.4 | 0.194 | 3.79 | 75.5 | 0.9 |
| G | 3500 (BC) | 2.97 | 45.5 | 0.044 | 2.97 | 63.6 | −18.1 |
| G | 3500 (BC) | 3.07 | 49.0 | 0.072 | 2.04 | 62.8 | −13.8 |
| G | 3500 (BC) | 4.02 | 53.7 | 0.079 | 2.02 | 65.5 | −11.8 |
| G | 3500 (BC) | 4.02 | 59.5 | 0.119 | 2.02 | 67.0 | −7.5 |
| G | 3500 (BC) | 5.04 | 64.2 | 0.159 | 3.03 | 735 | −9.3 |
| G | 3500 (BC) | 4.98 | 65.9 | 0.165 | 3.00 | 73.5 | −7.6 |
| H | 3500 (BC) | 3.07 | 54.4 | 0.061 | 1.35 | 60.8 | −6.4 |
| H | 3500 (BC) | 3.84 | 58.5 | 0.100 | 1.54 | 64.7 | −6.2 |
| H | 3500 (BC) | 5.01 | 60.9 | 0.090 | 2.05 | 68.5 | −7.6 |
| I | 4000 (BC) | 3.04 | 52.9 | 0.107 | 2.24 | 64.6 | −11.7 |
| I | 4000 (BC) | 3.05 | 52.6 | 0.086 | 2.26 | 63.8 | −11.2 |
| I | 4000 (BC) | 4.62 | 60.9 | 0.144 | 3.82 | 73.6 | −12.7 |
| I | 4000 (BC) | 4.53 | 60.1 | 0.159 | 2.26 | 70.5 | −10.4 |
| J | 5000 (BC) | 3.05 | 52.3 | 0.097 | 1.53 | 62.6 | −10.3 |
| J | 5000 (BC) | 4.62 | 61.8 | 0.144 | 3.82 | 73.6 | −11.8 |
| K | 5000 (Cl) | 3.08 | 50.5 | 0.176 | 2.26 | 67.5 | −17.0 |
| K | 5000 (Cl) | 4.41 | 60.6 | 0.228 | 2.21 | 72.8 | −12.2 |
| L | 5000 (OH) | 3.14 | 52.5 | 0.166 | 1.54 | 65.6 | −13.1 |
| L | 5000 (OH) | 4.63 | 64.1 | 0.160 | 3.05 | 72.5 | −8.4 |
| M | 10000 (BC) | 3.06 | 35.4 | 0.198 | 1.54 | 66.7 | −31.3 |
| M | 10000 (BC) | 4.49 | 41.6 | 0.142 | 2.94 | 71.2 | −29.6 |
| N | 10000 (Cl) | 3.03 | 34.9 | 0.166 | 2.24 | 66.9 | −32.0 |
| N | 10000 (Cl) | 4.54 | 47.7 | 0.271 | 1.52 | 73.3 | −25.6 |
| P | 10000 (OH) | 3.03 | 33.9 | 0.112 | 1.49 | 63.1 | −29.2 |
| P | 10000 (OH) | 4.55 | 45.6 | 0.160 | 2.26 | 70.6 | −25.0 |

TABLE 2-continued

| MAT RESULTS ON SODIUM CONTAMINATED, STEAMED CATALYSTS | | | | | | | |
|---|---|---|---|---|---|---|---|
| CAT # | NA, PPM (SALT) | CAT/OIL RATIO | CONV. WT % | $H_2$ WT % | COKE WT % FF | PRED.[1] CONV. | CONV. DIFF. |
| Q | 15000 (BC) | 3.09 | 31.0 | 0.170 | 0.76 | 63.9 | −32.9 |
| Q | 15000 (BC) | 4.63 | 31.7 | 0.127 | 1.53 | 67.8 | −36.1 |
| R | 15000 (Cl) | 4.54 | 34.8 | 0.286 | 1.50 | 73.8 | −39.0 |
| S | 15000 (OH) | 4.34 | 32.2 | 0.210 | 2.16 | 71.8 | −39.6 |

[1]Predicted Conversion, Wt % = 2.52* cat/oil + 39.7* Hydrogen + 2.27* Coke + 47.6

Since many materials are known or claimed to passivate the nickel and/or vanadium contaminants commonly found in FCC catalysts, eight of these materials were evaluated as sodium passivators. Fresh calcined catalyst was impregnated with 4000 ppm sodium from the bicarbonate salt and 5/1 Na/metal molar ratios of passivators. The compounds used were antimony pentoxide suspension, bismuth nitrate, cerium oxide suspension, magnesium acetate, ammonium molybdate, tin oxide suspension, titanium organic chelate (Tyzor 131) or zirconium versalate. These catalysts were calcined and steamed at 760° C. for 6.5 hours as were previous catalysts, then MAT evaluated at 482° C. reactor temperature and at 3.0 and 4.5 approximate catalyst/oil ratios. The MAT results from these experiments are shown as catalysts T through A2 in Table 3. Using the predicted conversion equation determined previously, the data from these experiments were used to calculate predicted conversions for comparison as shown in Table 3. The level of conversion difference in these experiments was compared to the 11.5 wt% average deactivation determined from catalyst I containing 4000 ppm sodium only as shown in Table 2. Six of the known nickel and/or vanadium passivators failed to provide any observed benefit and resulted in significant further deactivation of the catalyst. Catalysts W and A2 passivated with magnesium or zirconium, respectively, showed essentially no effect on the sodium. These results clearly show that materials known or claimed to passivate nickel/vanadium contaminants on FCC catalysts can not be presumed to be effective against alkali contaminants, specifically added sodium. However, these materials may be used to passivate nickel and/or vanadium contaminants in conjunction with a material suitable to passivate sodium contaminants.

TABLE 3

| MAT RESULTS ON SODIUM CONTAMINATED, METAL PASSIVATED, STEAMED CATALYSTS | | | | | | | | |
|---|---|---|---|---|---|---|---|---|
| CAT. # | 4000 Na + Pass | CAT/OIL RATIO | CONV. WT % | H2 WT % FF | COKE WT % FF | PRED.[1] CONV. | CONV. DIFF. | % PREV.[2] |
| T | 4239,Sb | 3.08 | 47.9 | 0.240 | 2.27 | 70.1 | −22.2 | −93 |
| | Sb205 | 4.54 | 56.4 | 0.284 | 2.26 | 75.5 | −19.1 | −66 |
| U | 7272,Bi | 3.08 | 51.0 | 0.217 | 2.27 | 69.1 | −18.1 | −58 |
| | BiNO3 | 4.61 | 59.9 | 0.296 | 3.82 | 79.6 | −19.7 | −72 |
| V | 4876,Ce | 3.01 | 35.2 | 0.090 | 1.48 | 62.1 | −26.9 | −135 |
| | CeO2susp | 4.49 | 60.7 | 0.131 | 2.99 | 70.9 | −10.2 | 11 |
| W | 846,Mg | 3.05 | 50.7 | 0.131 | 1.50 | 63.9 | −13.2 | −15 |
| | Mg(Ac)2 | 4.54 | 61.8 | 0.179 | 3.01 | 73.0 | −11.2 | 2 |
| X | 3339,Mo | 3.09 | 39.6 | 0.185 | 3.85 | 71.5 | −31.9 | −178 |
| | NH4MoO4 | 4.64 | 40.0 | 0.245 | 7.69 | 86.5 | −46.5 | −306 |
| Y | 4130,Sn | 3.10 | 40.1 | 0.298 | 2.31 | 72.5 | −32.4 | −183 |
| | SnO2susp | 4.52 | 57.0 | 0.426 | 3.01 | 82.8 | −25.8 | −125 |
| Z | 1667,Ti | 3.06 | 48.6 | 0.086 | 1.50 | 62.1 | −13.5 | −18 |
| | Chelate | 4.46 | 47.8 | 0.140 | 2.21 | 69.4 | −21.6 | −89 |
| A2 | 3174,Zr | 3.08 | 54.1 | 0.109 | 1.52 | 63.1 | −9.0 | 21 |
| | Zr Versl | 4.59 | 56.1 | 0.161 | 1.52 | 69.0 | −12.9 | −13 |

[1]Predicted Conversion, Wt % = 2.52 * cat/oil + 39.7 * Hydrogen + 2.27 * coke + 47.6

[2]% Prevention of Lost Activity = $\frac{\text{conversion diff(passivated)} + 11.5}{11.5} * 100\%$ To determine the passivation benefit of aluminum against contaminant sodium, five different aluminum containing compounds were added at 1/1 to 4/1 Na/Al molar ratios with 3500 ppm contaminant sodium (bicarbonate) to the Katalystics catalyst. These compounds were the fluoride, isopropoxide, nitrate, oxide suspension and sulfate salts of aluminum. These catalysts were prepared and steam deactivated as were previous catalysts, then MAT evaluated using 3.0, 4.0, and 5.0 approximate cat/oil ratios at 482° C. reactor temperature. A total of 72 MAT experiments were performed on 24 different samples, catalysts B20 through Z2 as shown in Table 4. As was done with the passivated catalysts shown in Table 3, predicted conversions, conversion differences and % prevention of lost activities were determined on these catalysts. As shown in Table 4, all levels of aluminum from the sulfate salt resulted in 17 to 66% average prevention of lost activity. Similarly, all levels of aluminum from the nitrate salt except 1028 ppm Al resulted in 11 to 58% average prevention of lost activity. In contrast, none of the four levels of aluminum from the fluoride salt provided consistent prevention of lost activity, with the higher levels of Al showing some further catalyst deactivation. Catalysts passivated with aluminum from oxide or isopropoxide salts (catalysts U2 - W2 and X2 -Z2, respectively) showed prevention of lost activity in five of six catalysts as shown in Table 4. The apparent ineffectiveness of aluminum fluoride in preventing lost activity may be related to the high concentration of fluoride ion in catalysts $N_2$ and $P_2$ (8686 ppm fluoride) or $Q_2$ (6515 ppm fluoride). Addition of halogen containing compounds to fluid catalytic cracking catalyst processes is potentially detrimental due to destruction of the zeolite through acid attack during hydrothermal treatment and regeneration of the catalyst.[1]

[1] FCC Catalysts Sensitive to Alkali Contaminants, Letzoch, W. S. and O. W. Wallace, *Oil and Gas JOurnal*, Nov. 29, 1982.

TABLE 4

MAT RESULTS ON SODIUM CONTAMINATED, ALUMINUM PASSIVATED, STEAMED CATALYSTS

| CAT # | 3500 Na + Pass | CAT/OIL RATIO | CONV. WT % | $H_2$ WT % FF | COKE WT % FF | PRED.[1] CONV. | CONV. DIFF. | % PREV.[2] |
|---|---|---|---|---|---|---|---|---|
| B2 | 4109,Al | 3.03 | 47.6 | 0.066 | 2.04 | 62.5 | −14.9 | −52 |
| | SO4 | 4.02 | 60.7 | 0.130 | 2.04 | 67.5 | −6.8 | 31 |
| | | 5.02 | 65.2 | 0.148 | 3.06 | 73.1 | −7.9 | 19 |
| C2 | 4109,Al | 2.91 | 52.0 | 0.048 | 1.08 | 59.3 | −7.3 | 26 |
| | SO4 | 3.83 | 56.4 | 0.042 | 2.03 | 63.5 | −7.1 | 28 |
| | | 4.84 | 63.6 | 0.098 | 2.08 | 68.4 | −4.8 | 51 |
| D2 | 3082,Al | 2.95 | 52.1 | 0.039 | 0.76 | 58.3 | −6.2 | 37 |
| | SO4 | 4.02 | 57.3 | 0.037 | 1.24 | 62.0 | −4.7 | 52 |
| | | 5.02 | 68.9 | 0.107 | 1.45 | 67.8 | +1.1 | 111 |
| E2 | 2055,Al | 3.04 | 58.2 | 0.088 | 2.04 | 63.4 | −5.2 | 47 |
| | SO4 | 4.05 | 61.5 | 0.149 | 2.04 | 68.4 | −6.9 | 30 |
| | | 5.05 | 72.4 | 0.311 | 3.04 | 79.6 | −7.2 | 27 |
| F2 | 2055,Al | 2.89 | 53.1 | 0.049 | 0.92 | 58.9 | −5.8 | 41 |
| | SO4 | 3.88 | 56.8 | 0.038 | 1.32 | 61.9 | −5.1 | 48 |
| | | 4.88 | 64.8 | 0.214 | 1.27 | 71.3 | −6.5 | 34 |
| G2 | 1028,Al | 2.80 | 46.1 | 0.079 | 0.98 | 60.0 | −13.9 | −42 |
| | SO4 | 3.80 | 60.3 | 0.088 | 1.14 | 63.3 | −3.0 | 69 |
| | | 4.83 | 66.6 | 0.156 | 1.45 | 69.3 | −2.7 | 72 |
| H2 | 4109,Al | 2.99 | 52.6 | 0.105 | 2.02 | 63.9 | −11.3 | −15 |
| | NO3 | 4.00 | 59.0 | 0.141 | 2.04 | 67.9 | −8.9 | 9 |
| | | 5.05 | 66.6 | 0.215 | 2.02 | 73.5 | −6.9 | 30 |
| I2 | 4109,Al | 2.92 | 48.6 | 0,069 | 1.05 | 60.1 | −11.5 | −17 |
| | NO3 | 4.06 | 53.8 | 0.076 | 1.10 | 63.4 | −9.6 | 2 |
| | | 4.89 | 64.9 | 0.141 | 1.47 | 68.9 | −4.0 | 59 |
| J2 | 3082,Al | 2.76 | 47.8 | 0.040 | 1.05 | 58.5 | −10.7 | −9 |
| | NO3 | 3.89 | 55.7 | 0.107 | 1.29 | 64.6 | −8.9 | 9 |
| | | 4.38 | 63.1 | 0.123 | 1.10 | 66.0 | −2.9 | 70 |
| K2 | 2055,Al | 2.90 | 48.0 | 0.036 | 1.46 | 59.7 | −11.7 | −19 |
| | NO3 | 3.80 | 62.6 | 0.107 | 1.14 | 64.0 | −1.4 | 86 |
| | | 4.77 | 65.8 | 0.108 | 1.24 | 66.7 | −0.9 | 91 |
| L2 | 2055,Al | 3.08 | 57.2 | 0.086 | 2.04 | 63.4 | −6.2 | 37 |
| | NO3 | 4.07 | 65.8 | 0.126 | 2.04 | 67.5 | −1.7 | 83 |
| | | 5.10 | 71.3 | 0.228 | 2.04 | 74.1 | −2.8 | 71 |
| M2 | 1028,Al | 2.77 | 44.8 | 0.044 | 1.28 | 59.2 | −14.4 | −47 |
| | NO3 | 3.94 | 51.5 | 0.042 | 1.62 | 62.9 | −11.4 | −16 |
| | | 4.83 | 60.7 | 0.109 | 1.63 | 67.8 | −7.1 | 28 |
| N2 | 4109,Al | 2.89 | 43.8 | 0.081 | 0.78 | 59.9 | −16.1 | −64 |
| | F3 | 3.76 | 48.9 | 0.068 | 0.98 | 62.0 | −13.1 | −34 |
| | | 4.79 | 54.6 | 0.097 | 1.06 | 65.9 | −11.3 | −15 |
| P2 | 4109,Al | 3.05 | 50.7 | 0.047 | 1.43 | 60.4 | −9.7 | 1 |
| | F3 | 4.17 | 57.7 | 0.079 | 2.13 | 66.1 | −8.4 | 14 |
| | | 5.06 | 57.1 | 0.075 | 2.58 | 69.2 | −12.1 | −23 |
| Q2 | 3082,Al | 2.98 | 39.7 | 0.046 | 1.04 | 59.3 | −19.6 | −100 |
| | F3 | 3.86 | 50.4 | 0.076 | 0.69 | 61.9 | −11.5 | −17 |
| | | 4.95 | 57.7 | 0.136 | 1.09 | 68.0 | −10.3 | −5 |
| R2 | 2055,Al | 2.93 | 42.5 | 0.077 | 0.83 | 59.9 | −17.4 | −78 |
| | F3 | 3.88 | 52.5 | 0.072 | 0.74 | 61.9 | −9.4 | 4 |
| | | 4.59 | 59.3 | 0.058 | 1.28 | 64.4 | −5.1 | 48 |
| S2 | 2055,Al | 2.97 | 50.1 | 0.065 | 1.57 | 61.2 | −11.1 | −13 |
| | F3 | 4.00 | 57.5 | 0.100 | 1.88 | 65.9 | −8.4 | 14 |
| | | 5.03 | 63.4 | 0.097 | 2.19 | 69.1 | −5.7 | 42 |
| T2 | 1028,Al | 2.94 | 48.3 | 0.072 | 1.03 | 60.2 | −11.9 | −21 |
| | F3 | 3.87 | 53.8 | 0.086 | 1.63 | 64.5 | −10.7 | −9 |
| | | 4.93 | 62.8 | 0.113 | 1.82 | 68.6 | −5.8 | 41 |
| U2 | 4109,Al | 2.93 | 55.3 | 0.126 | 1.61 | 63.6 | −8.3 | 15 |
| | Al2O3 | 3.95 | 57.6 | 0.083 | 1.81 | 65.0 | −7.4 | 24 |
| | | 4.97 | 64.2 | 0.128 | 2.04 | 69.8 | −5.6 | 43 |
| V2 | 2055,Al | 2.91 | 46.1 | 0.064 | 1.25 | 60.3 | −14.2 | −45 |
| | Al2O3 | 3.92 | 53.1 | 0.092 | 1.76 | 65.1 | −12.0 | −22 |
| | | 4.80 | 61.3 | 0.125 | 2.07 | 69.4 | −8.1 | 17 |
| W2 | 1028,Al | 3.00 | 51.0 | 0.077 | 1.47 | 61.6 | −10.6 | −8 |
| | Al2O3 | 3.94 | 60.3 | 0.114 | 1.54 | 65.6 | −5.3 | 46 |
| | | 4.86 | 65.0 | 0.127 | 2.09 | 69.6 | −4.6 | 53 |
| X2 | 4109,Al | 2.91 | 56.9 | 0.104 | 1.88 | 63.3 | −6.4 | 35 |
| | isopox | 3.75 | 57.5 | 0.131 | 2.25 | 67.4 | −9.9 | −1 |
| | | 4.87 | 69.0 | 0.143 | 3.07 | 72.5 | −3.5 | 64 |
| Y2 | 2055,Al | 2.82 | 53.0 | 0.089 | 1.47 | 61.6 | −8.6 | 12 |
| | isopox | 3.84 | 57.5 | 0.116 | 1.92 | 66.2 | −8.7 | 11 |
| | | 4.70 | 62.1 | 0.139 | 2.59 | 70.8 | −8.7 | 11 |
| Z2 | 1028,Al | 2.85 | 59.2 | 0.098 | 1.85 | 62.9 | −3.7 | 62 |
| | isopox | 3.83 | 62.4 | 0.123 | 2.03 | 66.7 | −4.4 | 55 |

TABLE 4-continued

| CAT # | 3500 Na + Pass | CAT/OIL RATIO | CONV. WT % | $H_2$ WT % FF | COKE WT % FF | PRED.[1] CONV. | CONV. DIFF. | % PREV.[2] |
|---|---|---|---|---|---|---|---|---|
| | | 4.86 | 65.4 | 0.130 | 2.23 | 70.1 | −4.7 | 52 |

MAT RESULTS ON SODIUM CONTAMINATED, ALUMINUM PASSIVATED, STEAMED CATALYSTS

[1]Predicted Conversion, Wt % = 2.52 * cat/oil + 39.7 * Hydrogen + 2.27 * Coke + 47.6

[2]% Prevention of Lost Activity = $\frac{\text{conversion diff(passivated)} + 9.8}{9.8}$ * 100%

To confirm the passivation effects of aluminum components on sodium, an alternate silica-alumina zeolite cracking catalyst manufactured by the Filtrol Corporation was used. This fresh catalyst was calcined at 649° C. for 0.5 hours, then steamed at 760° C. for 6.5 hours. The fresh calcined catalyst was also impregnated with 4000 ppm sodium (from the bicarbonate salt), calcined at 649° C. for 1 hour, then steamed at 760° C. for 6.5 hours. These two catalysts (A3 and B3) were evaluated for catalyst activity using the MAT procedure at approximate catalyst/oil ratios of 3.0, 4.0 and 5.0. These 12 experiments were conducted at 515° C. at an approximate weight hourly space velocity of 32 $hr^{-1}$ with results shown in Table 5. The 4000 ppm sodium was found to reduce catalyst activity an average of 17.8 wt %. The data from these 12 experiments were used to determine a predicted conversion linear regression equation as follows:

Predicted Conversion, Wt %=−0.00445 * sodium, ppm+3.88 * cat/oil+67.1.

This equation was found to exhibit a confidence level of 99.99+% with 95.4% of the data fitting the line.

Fresh calcined Filtrol catalyst was impregnated with 4000 ppm sodium (bicarbonate) and 1174, 2348 or 4696 ppm aluminum from the oxide, nitrate, or sulfate salts or 2348 or 4696 ppm aluminum from the isopropoxide salt. These catalysts (C3 to M3) were calcined, steam deactivated, then MAT evaluated as was catalyst B3 containing sodium only. The results from these 33 MAT experiments are shown in Table 6 along with predicted conversions calculated using the above determined equation.

Of the three catalysts passivated with aluminum oxide, only catalyst D3 showed a positive average prevention of lost activity. Previous results on aluminum oxide passivated Katalystics catalysts (U2 to W2) showed two of the three catalysts to provide positive benefit. The remaining 8 catalysts passivated with other aluminum compounds (sulfate, isopropoxide or nitrate salts) all showed 21 to 52% average prevention of lost activity as shown in Table 6. previous results obtained on Katalystics catalysts passivated with these aluminum compounds (catalysts B2 to M2 and X2 to Y2) indicated positive average prevention of lost activity in 13 of 15 catalysts, all except B2 and M2.

TABLE 5

MAT RESULTS ON FRESH AND SODIUM CONTAMINATED, STEAMED FILTROL CATALYST

| CAT # | SODIUM PPM | CAT/OIL RATIO | CONV. WT % | $H_2$ W % FF | COKE WT % FF | PRED.[1] CONV. | CONVERSION DIFFERENCE |
|---|---|---|---|---|---|---|---|
| A 3 | 0 | 3.04 | 78.1 | 0.130 | 3.06 | 78.8 | −0.7 |
| | 0 | 4.03 | 82.5 | 0.160 | 4.07 | 82.7 | −0.2 |
| | 0 | 5.01 | 84.8 | 0.140 | 5.06 | 86.5 | −1.7 |
| | 0 | 2.99 | 80.6 | 0.081 | 2.22 | 78.7 | 1.9 |
| | 0 | 4.08 | 83.3 | 0.099 | 2.33 | 82.9 | 0.4 |
| | 0 | 4.82 | 86.0 | 0.154 | 3.57 | 85.8 | 0.2 |
| B 3 | 4000 | 4.01 | 64.3 | 0.096 | 0.88 | 64.8 | −0.5 |
| | 4000 | 5.17 | 67.2 | 0.096 | 0.77 | 69.3 | −2.1 |
| | 4000 | 3.02 | 61.0 | 0.073 | 0.84 | 61.0 | 0.0 |
| | 4000 | 4.11 | 63.3 | 0.105 | 0.78 | 65.2 | −1.9 |
| | 4000 | 4.99 | 73.6 | 0.116 | 1.74 | 68.6 | 5.0 |
| | 4000 | 3.03 | 60.5 | 0.176 | 0.73 | 61.0 | −0.5 |

[1]Predicted Conversion, Wt % = −0.00445* Na(ppm) + 3.88* cat/oil + 67.1

TABLE 6

MAT RESULTS ON SODIUM CONTAMINATED, ALUMINUM PASSIVATED, STEAMED FILTROL CATALYSTS

| CAT. # | 4000 Na + Pass | CAT/OIL RATIO | CONV. WT % | $H_2$ WT % FF | COKE WT % FF | PRED.[1] CONV. | CONV. DIFF. | % PREV[2] |
|---|---|---|---|---|---|---|---|---|
| C3 | 4696,Al | 3.05 | 54.0 | 0.083 | 0.61 | 61.1 | −7.1 | −40 |
| | Al2O3 | 4.06 | 60.6 | 0.110 | 0.77 | 65.0 | −4.4 | −25 |
| | | 5.05 | 64.7 | 0.120 | 1.06 | 68.8 | −4.1 | −23 |
| D3 | 1174,Al | 3.02 | 60.6 | 0.108 | 0.91 | 61.2 | −0.6 | −3 |
| | Al2O3 | 4.03 | 67.2 | 0.103 | 1.17 | 64.9 | 2.3 | 13 |
| | | 5.15 | 74.2 | 0.129 | 1.35 | 69.2 | 5.0 | 28 |
| E3 | 2348,Al | 3.03 | 58.8 | 0.096 | 1.06 | 61.0 | −2.2 | −12 |
| | Al2O3 | 3.03 | 58.3 | 0.087 | 1.28 | 61.0 | −2.7 | −15 |
| | | 4.95 | 68.6 | 0.117 | 1.29 | 68.5 | 0.1 | 0 |
| F3 | 2348,Al | 3.03 | 66.8 | 0.074 | 1.91 | 61.0 | 5.8 | 33 |
| | SO4 | 4.14 | 71.5 | 0.092 | 2.82 | 65.3 | 6.2 | 35 |
| | | 5.04 | 72.8 | 0.091 | 2.41 | 68.8 | 4.0 | 23 |
| G3 | 4696,Al | 3.02 | 68.7 | 0.095 | 1.87 | 61.0 | 7.7 | 44 |
| | SO4 | 4.04 | 75.0 | 0.137 | 1.90 | 64.9 | 10.1 | 57 |
| | | 4.87 | 71.6 | 0.108 | 1.96 | 68.1 | 3.5 | 20 |

TABLE 6-continued

MAT RESULTS ON SODIUM CONTAMINATED, ALUMINUM PASSIVATED, STEAMED FILTROL CATALYSTS

| CAT. # | 4000 Na + Pass | CAT/OIL RATIO | CONV. WT % | $H_2$ WT % FF | COKE WT % FF | PRED.[1] CONV. | CONV. DIFF. | % PREV[2] |
|---|---|---|---|---|---|---|---|---|
| H3 | 1174,Al | 3.03 | 63.8 | 0.094 | 1.49 | 61.0 | 2.8 | 16 |
| | SO4 | 2.99 | 62.1 | 0.088 | 1.71 | 60.9 | 1.3 | 7 |
| | | 4.89 | 74.9 | 0.113 | 2.00 | 68.2 | 6.7 | 38 |
| I3 | 4696,Al | 2.98 | 59.1 | 0.074 | 1.52 | 60.8 | −1.7 | −10 |
| | ISOPOX | 3.94 | 75.2 | 0.099 | 2.44 | 64.5 | 10.7 | 57 |
| | | 4.95 | 76.0 | 0.110 | 3.12 | 68.5 | 7.5 | 43 |
| J3 | 2348,Al | 2.94 | 64.2 | 0.080 | 2.26 | 60.7 | 3.5 | 20 |
| | ISOPOX | 4.05 | 73.4 | 0.083 | 2.03 | 65.0 | 8.4 | 48 |
| | | 4.89 | 77.1 | 0.107 | 2.10 | 68.2 | 8.9 | 51 |
| K3 | 4696,Al | 3.00 | 68.3 | 0.081 | 1.74 | 60.9 | 7.4 | 42 |
| | NO3 | 3.99 | 77.6 | 0.122 | 2.12 | 64.7 | 12.9 | 73 |
| | | 4.96 | 75.6 | 0.122 | 2.23 | 68.5 | 7.1 | 40 |
| L3 | 1174,Al | 3.03 | 62.1 | 0.089 | 2.48 | 61.0 | 1.1 | 6 |
| | NO3 | 4.07 | 70.1 | 0.099 | 2.97 | 65.0 | 5.1 | 28 |
| | | 5.02 | 76.5 | 0.110 | 3.37 | 68.7 | 7.8 | 44 |
| M3 | 2348,Al | 3.08 | 62.8 | 0.087 | 2.10 | 61.2 | 1.6 | 9 |
| | NO3 | 3.98 | 70.5 | 0.108 | 2.47 | 64.7 | 5.8 | 33 |
| | | 5.09 | 73.8 | 0.108 | 3.76 | 69.0 | 4.8 | 27 |

[1]Predicted Conversion, Wt % = −0.00445 * Na(ppm) + 3.88 * cat/oil + 67.1

[2]% Prevention of Lost Activity = $\frac{\text{conversion difference(passivated)}}{17.8}$ * 100%

From the combined results of Tables 4 and 6, it is apparent that aluminum compounds provide passivation benefits of contaminant sodium on FCC catalysts. Also, aluminum normally present in the catalyst as alumina matrix or in the zeolite appears to have no positive effect on passivation of contaminant sodium.

The appended claims and this invention generally should be construed to cover all such obvious forms and modifications which are within the true spirit and scope of the present invention.

What is claimed is:

1. In a hydrocarbon cracking process having a reactor devoid of added hydrogen and a regenerator containing oxygen-containing gas wherein a hydrocarbon material containing in excess of 0.5 ppm sodium contacts a zeolite containing cracking catalyst having reaction sites and said sodium contaminates said cracking catalyst by deposition onto said reaction sites, the improvement which comprises adding to said hydrocarbon material for deposition onto said catalyst during the cracking process a sufficient amount of an aluminum containing compound without halogen atoms for the purpose of reducing the contaminating effect of said sodium deposited on said catalyst by the hydrocarbon material.

2. The process of claim 1 wherein the concentration of said sodium in said hydrocarbon material is between about 2 ppm and 10 ppm.

3. The process of claim 1 wherein said catalyst contains at least an additional 2000 ppm of said sodium deposits above the sodium level present on the catalyst following manufacture.

4. The process of claim 1 wherein said aluminum containing compound is selected from the group consisting of aluminum isopropoxide, aluminum nitrate, aluminum oxide and sulfate salts of aluminum.

5. The process of claim 1 wherein said aluminum containing compound is aluminum sulfate.

6. The process of claim 1 wherein said aluminum containing compound is fed into said hydrocarbon material upstream from said reactor.

7. The process of claim 1 wherein said aluminum containing compound is fed into said reactor.

8. The process of claim 1 wherein said aluminum containing compound is added to said catalyst in said reactor.

9. The process of claim 1 wherein said aluminum containing compound is added to said catalyst in said regenerator.

10. The process of claim 1 wherein said aluminum containing compound which is added to said hydrocarbon material has a molar ratio of aluminum:sodium of from about 1:1 to 1:10.

11. The process of claim 1 wherein said aluminum containing compound which is added to said hydrocarbon material has a molar ratio of aluminum:sodium of from about 1:1 to about 1:4.

12. The process of claim 1 wherein additional metal passivators, selected from the group consisting of antimony, bismuth, cerium, magnesium, phosphorus, and sulfur, are also employed to reduce the effects of other catalyst poisons, such as nickel, vanadium, iron and copper, present in the feed.

13. The process of claim 12 wherein the catalyst poisons re selected from the group consisting of copper, iron, nickel, and vanadium.

* * * * *